US005713094A

United States Patent [19]

Markey et al.

[11] Patent Number: 5,713,094

[45] Date of Patent: Feb. 3, 1998

[54] WASHING IMPLEMENT

[75] Inventors: Kevin Joseph Markey, Westminster, Md.; Harry Hamilton Haubert, Freehold; Robert Olsson, Princeton Junction, both of N.J.; Kara Bonci, Tuckahoe, N.Y.

[73] Assignee: Lever Brothers Company, Division of Conopco, Inc., New York, N.Y.

[21] Appl. No.: 508,359

[22] Filed: Jul. 28, 1995

[51] Int. Cl.[6] ..... A47K 7/02

[52] U.S. Cl. ..... 15/229.11; 15/208; 601/154

[58] Field of Search ..... 15/229.11, 229.12, 15/229.13, 222, 229.14, 208; 300/21; 29/452; 264/103; 601/154

[56] References Cited

U.S. PATENT DOCUMENTS

| | | | |
|---|---|---|---|
| 1,357,411 | 11/1920 | Mosheim | 15/229.14 |
| 1,468,164 | 9/1923 | McCarty | 15/229.14 |
| 1,682,984 | 9/1928 | Raynor | 15/229.14 |
| 1,686,863 | 10/1928 | Kingman | 15/229.11 |
| 2,581,779 | 1/1952 | Abraham | 15/229.11 |
| 2,851,714 | 9/1958 | Goodloe | 15/229.11 |
| 3,343,196 | 9/1967 | Barnhouse | 15/229.11 |
| 5,295,280 | 3/1994 | Hudson et al. | 15/222 |
| 5,504,963 | 4/1996 | Bynum et al. | 15/222 |

FOREIGN PATENT DOCUMENTS

| | | | |
|---|---|---|---|
| 482997 | 8/1954 | Italy | 15/229.11 |

*Primary Examiner*—Tony G. Soohoo
*Attorney, Agent, or Firm*—Gerard J. McGowan, Jr.

[57] ABSTRACT

A washing implement is formed from links of mesh material and which is suitable for convenient use with a single hand. The hand sponge is formed by gathering loops or tubes of diamond mesh polymeric material into circular links, which are looped together to form the washing implement. At least two links are used and the links are tied closed at each end of the washing implement by a string or cord which connects the first and last links.

7 Claims, 2 Drawing Sheets

FIG. 1
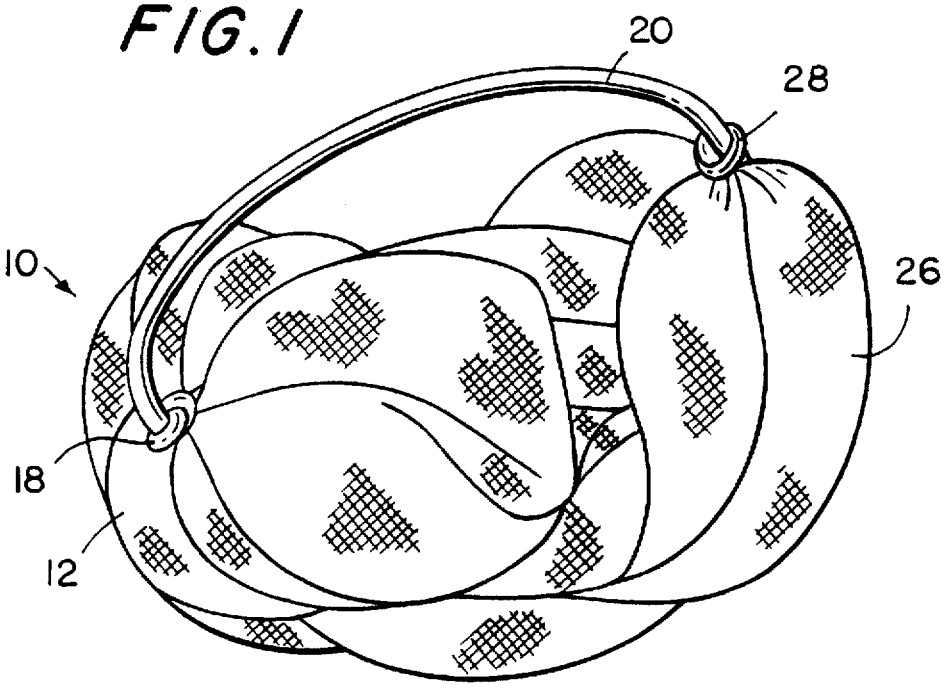
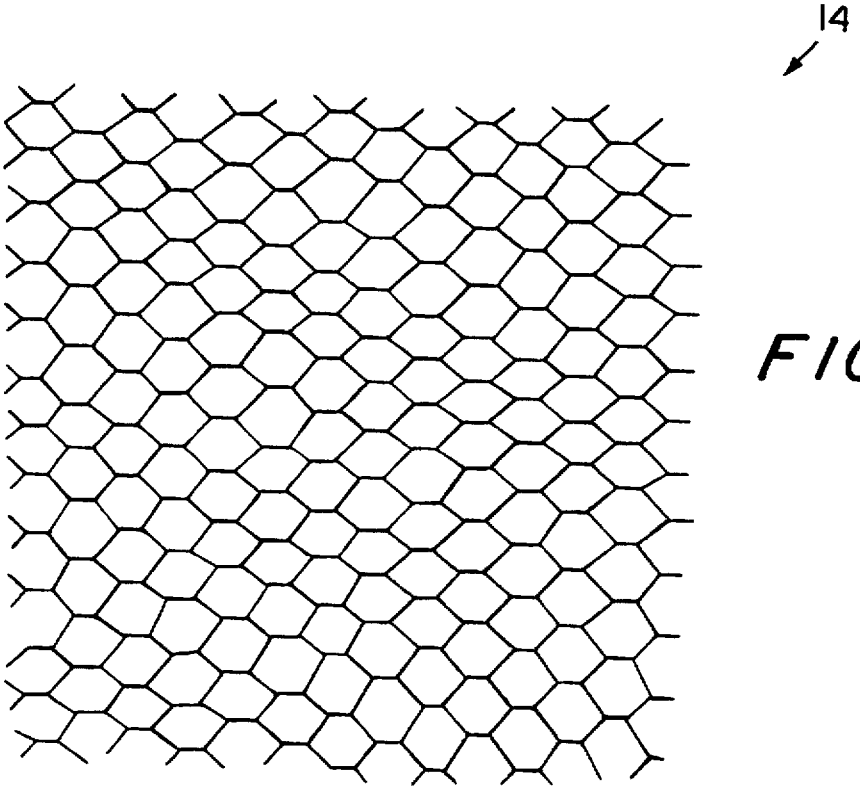
FIG. 2

WASHING IMPLEMENT

BACKGROUND OF THE INVENTION

Liquid personal washing cleansers have recently been gaining in popularity. A difficulty with their use is that there is lacking a solid, tangible washing implement, such as a soap bar, which the consumer is accustomed to use, e.g. in the shower. Also, it would be beneficial to improve the lathering of the liquid cleansers. Moreover, washing implements would need to be easy and convenient to use, preferably without the need to involve both hands.

Campagnoli, U.S. Pat. No. 5,144,744 discloses a diamond-mesh polyethylene sponge obtained by stretching a plurality of tubes, binding all of the tubes together near a common center of all of the stretched tubes and releasing all the tubes from their stretched condition whereby the tubes through their resiliency rebound into a rounded sponge shape. Rounded sponge shaped implements are sometimes perceived as appearing excessively "frilly" and as less likely to appeal to men than to women.

Hudson et al., U.S. Pat. No. 5,295,280 discloses a washing device for scrubbing the body which includes an elongate washing member formed of a plurality of interlooped box-like links. The washing device includes gripping handles in the form of loops at each end of the washing device. An object of the invention is to provide a washing device for scrubbing the body which involves both hands of the person washing and therefore can provide enhanced scrubbing action.

Sanford, U.S. Pat. No. 4,462,135 discloses a cleaning and abrasive scrubber which is made in part of numerous layers of netting mesh polymeric material.

WO 95/00116 discloses a system for cleaning the skin which comprises a diamond mesh sponge and a liquid cleansing and moisturizing composition said to have excellent lather.

Fleisher, U.S. Pat. No. 1,424,458 discloses a loop used to loop hosiery mill waste material together.

SUMMARY OF THE INVENTION

A new washing implement or sponge has been discovered which can be formed from links of mesh material and which is suitable for convenient use with a single hand. The hand sponge of the invention is formed by gathering loops or tubes of diamond mesh polymeric material into circular links, which are looped together to form the washing implement. At least two links are used and the links are tied closed at each end of the washing implement by a string or cord which connects the first and last links.

In a preferred embodiment, a central link and at least one first lateral link on one side of the central link and at least one second lateral link on the other side of the central link are employed. First and second lateral links at either end of the washing implement are tied closed and connected by the cord. The interlooped links form "braids" of mesh material which can absorb water and soap. The invention therefore provides a washing implement made from braided endless tubes which is convenient for use as a washing implement or sponge with a single hand and yet is less "frilly" in appearance than previous washing implements made of such materials.

The present washing implement is fabricated by gathering a tube or loop into a generally circular loop, folding the circular loop about its diameter to form a generally semi-circular link having one half superimposed upon the other, tying the two ends of the semi-circle together with the front end of a piece of cord at the front of the link, and folding a second loop formed from a loop about the back end of the semi-circular loop, opposite the tied end, to form a second link. If it is desired to include only two links in the washing implement, the second link is then tied at its back end, the end opposite that at which it is folded over the first link, with the back end of the cord which ties the first link.

If it is desired to use more than two links, the second link is not tied with cord. Rather, a third link is folded about the back end of the second link and the third link is then tied with the cord. As many links as may be required can be provided, and it is generally the first and the last links that will be tied off by, and connected together with, the cord. Preferably three links are used, namely a first lateral or front link, a central link and second lateral or back link, the first lateral and second lateral link being tied together by opposite ends of the cord.

It will be appreciated that the cleansing implement of the invention, since it is made of numerous layers of a mesh material, will be able to absorb liquid like a sponge. Also, as mentioned above, WO 95/00116 indicates that a system for cleaning the skin which comprises a diamond mesh sponge and a liquid cleansing and moisturizing composition generates excellent lather. The presence of the cord combined with the general shape of the washing implement will readily facilitate grasping of the implement by one hand of the user.

In a particularly preferred embodiment, the sponge is combined in a system with a moisturizing liquid cleanser. The sponge when used together with the cleanser enables the user to reach difficult body parts. Also, as suggested for prior sponges, the lathering of the cleanser may be enhanced.

For a more complete understanding of the above and other features and advantages of the invention, reference should be made to the following detailed description of the preferred embodiments and to the accompanying drawings.

BRIEF DESCRIPTION OF THE DRAWINGS

FIG. 1 is a perspective view of the washing implement of the invention.

FIG. 2 is a top plan view of diamond mesh polymeric material which may be used in the washing implement of the invention.

DETAILED DESCRIPTION OF THE INVENTION

The washing implement 10 is formed of a plurality of links 12, preferably made of a diamond mesh material 14. While the invention is described with reference to diamond mesh material, other materials, such as materials with meshes of other shapes, may be suitable.

The mesh material is preferably made of a polymer such as polyethylene and advantageously is somewhat resilient. The material may also be made of addition polymers of olefin monomers other than ethylene or of polyamides of polycarboxylic acids and polyamines. An alternative mesh material is nylon. The tubular netting mesh from which the links are formed are preferably strong, flexible polymeric materials. Extruded tubular netting mesh of this type have been used for the covering of meat and poultry carcasses. Such mesh materials are described in e.g., Sanford, U.S. Pat. No. 4,462,135, the disclosure of which is incorporated herein by reference.

Figure 3:
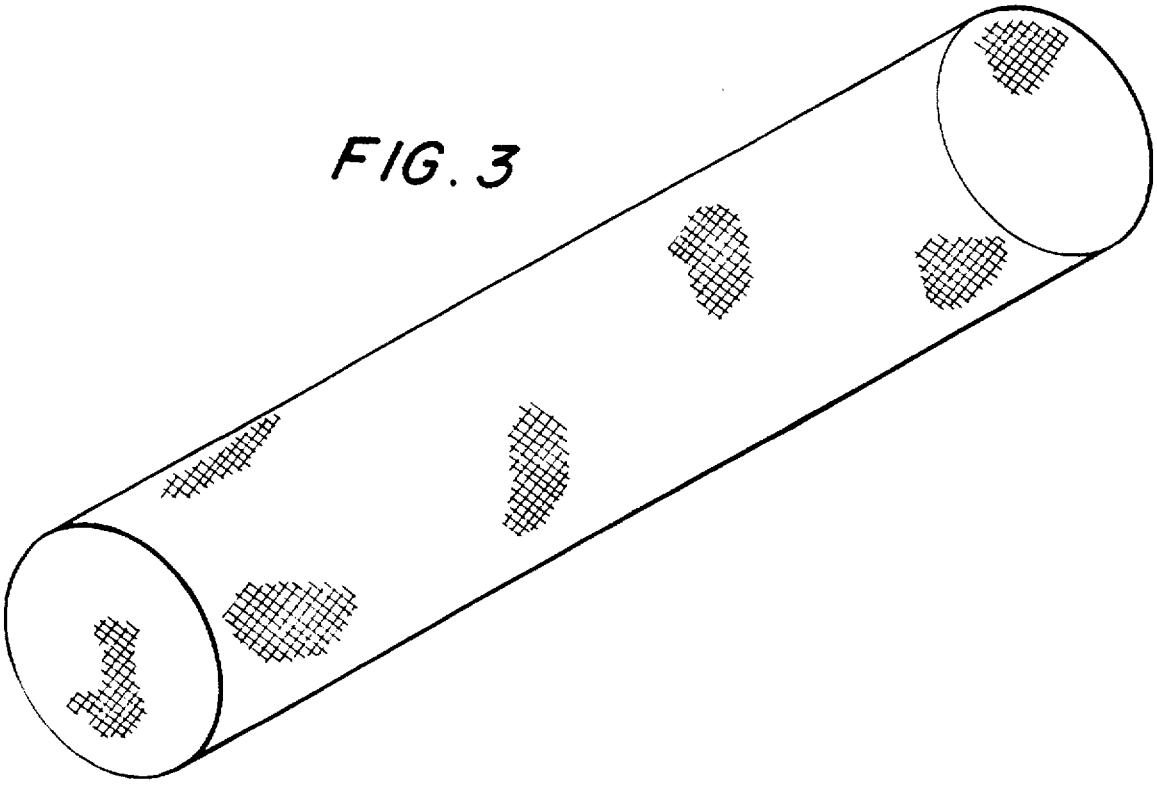
FIG. 3 is a perspective view of a tube of diamond mesh material used to form the links of the washing implement of the invention.

As seen in FIG. 3, the mesh is originally disposed in the form of a tube or loop. In order to prepare the links of the invention, the tube is compressed along its longitudinal axis to form a circular loop. The loop is then used to form the links shown in FIG. 1 end shown schematically in FIG. 4.

Figure 4:
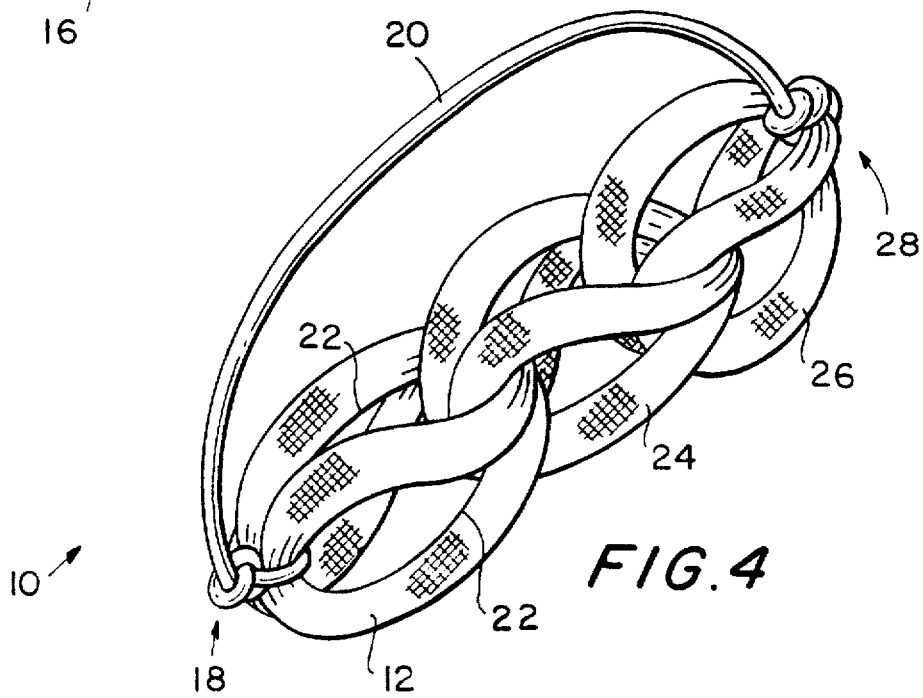
FIG. 4 is a perspective view of the washing implement of the invention with the loops shown schematically so that their structure can be better seen.

Washing implement 10 of FIG. 4 is formed by taking one of the loops formed as described above and folding it along a selected diameter to form a semi-circle of the mesh. The semi-circle comprises one-half of the circular loop superimposed upon the other. The two ends of the semi-circle are tied together at 18 as seen in FIG. 4 to form what can be considered to be the front of the washing implement. The front end of a single length of cord 20 is used in tying the halves of the semi-circle together. Cord 20 extends through space 22 formed between the superimposed halves of the loop 12.

After loop 12 is tied off at its front end, link 24 is inserted through the center of link 12 and folded about the back end of link 12, also forming a semi-circular tube wherein one-half of the loop is compressed upon the other but also wherein one end of the semi-circle is compressed against the other by virtue of loop 24 passing through loop 12.

Link 26 is formed similarly to links 12 and 24. Link 26 is passed through link 24 in a similar manner to that described for the passage of link 24 through link 12. As with the other links, link 26 comprises two halves of a circular loop superimposed or folded upon itself. At its back end 28, the two halves of the link are tied together by the back end of the cord 20. Preferably a single cord is used, extending from the front end 18 to the back end 28 of the washing implement.

Washing implement or sponge 10, therefore, includes a handle comprising cord 20 which may be used to grasp the implement in one hand and move the mesh material in the form of links over the surface of the body for cleansing. As can be seen in FIG. 1, the mesh links take up a substantial volume. Accordingly, the interior of the sponge can accommodate a substantial amount of water or liquid cleanser, which can be squeezed from the sponge as desired.

The braided configuration of the sponge of the present invention is believed to provide turbulent effect, incorporating more air into the cleaning formula with less netting material and improved lathering as compared to previous mesh materials. The washing implement is flexible and has a mild abrasive surface for gently scrubbing different portions of the body. The porosity of the mesh permits water and other cleansing liquids to penetrate the surface of the implement into the interior.

The number of links which may be used is not critical. For example, instead of the illustrated three links, two or greater than three, e.g. four or five or even more links may be used. However, three links have been found to provide a convenient sized sponge for the adult hand.

Preferably the sponge of the invention is used in conjunction with a liquid personal wash cleaning formulation which includes a surfactant and a skin conditioning and moisturizing ingredient. Preferably the surfactant is a mild surfactant. Among the mild surfactants which may be used are cocamidopropyl betaine and sodium cocoylisethionate. Among other surfactants which may be used are soap and sodium laureth sulfate. Among the moisturizers which may be used are glycerin mono, di and tri-esters, mineral oil and silicone oil. A preferred moisturizer is the dimethicone emulsion sold as Dow Q2-1656, which is a 50% silicone emulsion. Thickeners such as ammonium sulfate and opacifiers such as mica/titanium dioxide may be used.

The cord tying the two ends of the sponge together may be made of a natural material such as rope or a synthetic polymer such as nylon, polyethylene or polypropylene.

It should be understood of course that the specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. A washing implement comprising a central link having a first side and a second side opposite said first side formed from a loop, said central link having a diameter, one or more first lateral links each formed from a loop on the first side of said central link, each said first lateral link having a diameter, one of said first lateral links being adjacent to said central link, said one or more first lateral links each being folded about an axis, said axis extending through the diameter of each said first lateral link, to form a semicircle wherein one half of the loop is superimposed upon the other, said central link being folded about an axis, said axis extending through the central link diameter, said central link being folded around the superimposed half loops of the adjacent one of said folded first lateral links to form superimposed half loops of said central link, one or more second lateral links on the second side of said central link, one of said second lateral links being disposed adjacent said central link, the adjacent one of said second lateral links being folded around the superimposed half loops of said folded central link, and a cord having two ends, said cord securing and connecting a first lateral link furthest from said central link with a second lateral link furthest from said central link, any further first or second lateral links each having a diameter and an axis extending along the diameter said further links being folded around superimposed half loops of an adjacent link to form superimposed half loops.

2. The washing implement of claim 1 wherein said implement comprises a single central link, a single first lateral link and a single second lateral link.

3. The washing implement of claim 1 wherein said loops comprise a polymeric mesh material.

4. The washing implement of claim 3 wherein said polymeric mesh material is diamond mesh.

5. A washing implement having a front and a back end, said washing implement comprising a plurality of links, each of which is formed from a loop, each said link having a front end and a back end, one of said links being disposed at the front end of said washing implement and being folded into a semicircle loop, the ends of said semicircle being tied together at said front end by a first end of a cord, another of said other links being folded about the back end of said semicircle loop opposite to said tied end, one of said links other than the link disposed at the front end of said washing implement being disposed at the back end of said washing implement and being folded into a semicircle loop about the back end of a previous loop and having the ends of its semicircle tied at the back end of said back end loop by the other end of said cord, said cord connecting the front and the back of said washing implement.

6. The washing implement of claim 5 wherein said loops comprise a polymeric mesh material.

7. The washing implement of claim 6 wherein said polymeric mesh material is diamond mesh.

* * * * *